US005601063A

United States Patent [19]

Ohashi et al.

[11] Patent Number: 5,601,063

[45] Date of Patent: Feb. 11, 1997

[54] FAIL-SAFE ENGINE ACCELERATOR-THROTTLE CONTROL

[75] Inventors: Hideyuki Ohashi, Toyota; Kazuhiro Nishigaki, Gifu; Sanae Hirata, Okazaki, all of Japan

[73] Assignee: Nippondenso Co., Ltd., Japan

[21] Appl. No.: 591,973

[22] Filed: Jan. 29, 1996

[30] Foreign Application Priority Data

Feb. 2, 1995 [JP] Japan ..... 7-015879
Oct. 27, 1995 [JP] Japan ..... 7-280927

[51] Int. Cl.[6] ..... F02D 7/00

[52] U.S. Cl. ..... 123/396

[58] Field of Search ..... 123/396, 492, 123/397, 398, 198 D, 129.18, 182 S, 403, 342

[56] References Cited

U.S. PATENT DOCUMENTS 5,263,448 11/1993 Bluhm et al. ..... 123/396
5,297,521 3/1994 Sasaki et al. ..... 123/396
5,429,090 7/1995 Kotchi et al. ..... 123/396
5,435,284 7/1995 Shimizu et al. ..... 123/396
5,447,133 9/1995 Kamio et al. ..... 123/396

FOREIGN PATENT DOCUMENTS 60-53631 3/1985 Japan ..... 123/396
60-195344 10/1985 Japan ..... 123/396
63-134837 6/1988 Japan ..... 123/396
5-306636 11/1993 Japan ..... 123/396

*Primary Examiner*—Raymond A. Nelli
*Attorney, Agent, or Firm*—Nixon & Vanderhye P.C.

[57] ABSTRACT

A throttle control CPU drives an electric motor throttle valve control based on an accelerator position. When detecting an abnormality in the throttle opening control system, a main CPU stops driving the electric motor and controls fuel injection amount and/or ignition timing to curb engine output torque increases otherwise caused by a valve opening movement (performed until a cooperative member connected to the throttle valve contacts a restricting member mechanically connected to the accelerator pedal). Thereafter, opening of the throttle valve is regulated according to the accelerator pedal position while the restricting member and the cooperative member remain in contact. The control apparatus smoothly shifts the throttle opening regulation to the fail-safe mode when an abnormality occurs by actively controlling engine speed changes during mode transition.

55 Claims, 11 Drawing Sheets

| GEAR POSITION \ CYLINDER NUMBER | #1 | #2 | #3 | #4 | #5 | #6 | #7 | #8 | |
|---|---|---|---|---|---|---|---|---|---|
| 1, R | 1 | 0 | 1 | 0 | 1 | 0 | 1 | 0 | (#4 OMITTED) |
| 2 | 1 | 0 | 1 | 0 | 0 | 1 | 0 | 0 | (#3 OMITTED) |
| 3 | 1 | 0 | 0 | 0 | 1 | 0 | 0 | 0 | (#2 OMITTED) |
| 4, 5 | 1 | 0 | 0 | 0 | 0 | 0 | 0 | 0 | (#1 OMITTED) |

1··· FUEL INJECTION OMITTED
0··· FUEL INJECTION AS NORMAL t10(ABNORMALITY IS DETECTED)
OMITTED FUEL INJECTION CYLINDER 7

NORMAL FUEL INJECTION

NORMAL FUEL INJECTION

OMITTED FUEL INJECTION CYLINDER 1

NORMAL FUEL INJECTION

OMITTED FUEL INJECTION CYLINDER 3

OMITTED FUEL INJECTION CYLINDER 5

[°CA]
0
180
360
540
720
(0)

FAIL-SAFE ENGINE ACCELERATOR-THROTTLE CONTROL

BACKGROUND OF THE INVENTION

1. Field of the Invention

The present invention relates to a fail-safe engine accelerator-throttle control. The exemplary embodiment detects operation of an accelerator pedal to control the opening of a throttle valve actuator, such as a motor, and controls the throttle valve opening by a predetermined fail-safe mode when an abnormality occurs.

2. Description of Related Art

Japanese unexamined patent application publication No. HEI 5-306636 discloses a similar type engine control. Such prior engine control detects operation of an accelerator pedal and accordingly controls the opening of a throttle valve during normal engine operation. When an abnormality occurs, a restricting member mechanically connected to the accelerator pedal is brought into contact with a cooperative member connected to the throttle valve in order to control the throttle valve opening. When an abnormality is detected, a motor is slowly operated to slowly bring the cooperative member into contact with the restricting member so that control smoothly enters a mechanical throttle control mode (limp-home mode).

However, if the abnormality includes the motor in, for example, shifting to a fail-safe engine control mode, smooth entry into the fail-safe mode fails because the motor cannot be properly controlled.

BRIEF SUMMARY OF THE INVENTION

The present invention smoothly enters the fail-safe mode when an abnormality occurs.

A throttle opening control drives a throttle actuator in accordance with operation of an accelerator detected by an accelerator sensor. An abnormality detector detects an abnormality of at least one of: (a) the accelerator sensor and (b) the throttle actuator. An actuator stop stops the throttle actuator when an abnormality is detected. By stopping the throttle actuator, the throttle valve shifts toward the opening side (that is, in the opening direction). However, a cooperative member abuts a restricting member to restrict the throttle valve from farther shifting toward the opening side. While the restricting member and the cooperative member are in contact, the opening of the throttle valve is controlled in accordance with the operation of the accelerator member.

In addition, when an abnormality is detected, output torque is controlled by at least one of: (a) the amount of fuel to be injected into the engine, and (b) ignition timing. This curbs an undesired increase in engine output torque caused by the limited opening of the throttle valve which occurs after the throttle actuator drive is stopped and until the restricting member abuts the cooperative member so as to enter the fail-safe mechanical mode. With this construction, when an abnormality occurs, the engine control thus prevents a sharp increase in engine speed and ensures a smooth mode shift to the mechanical throttle opening control mode (fail-safe mode).

BRIEF DESCRIPTION OF THE DRAWINGS

The foregoing and further objects, features and advantages of the present invention will become apparent from the following description of exemplary embodiments with reference to the accompanying drawings, wherein:

FIGS. 6A to 6C are timing charts of the illustrated exemplary engine control;

DETAILED DESCRIPTION OF EXEMPLARY EMBODIMENT

Figure 1:
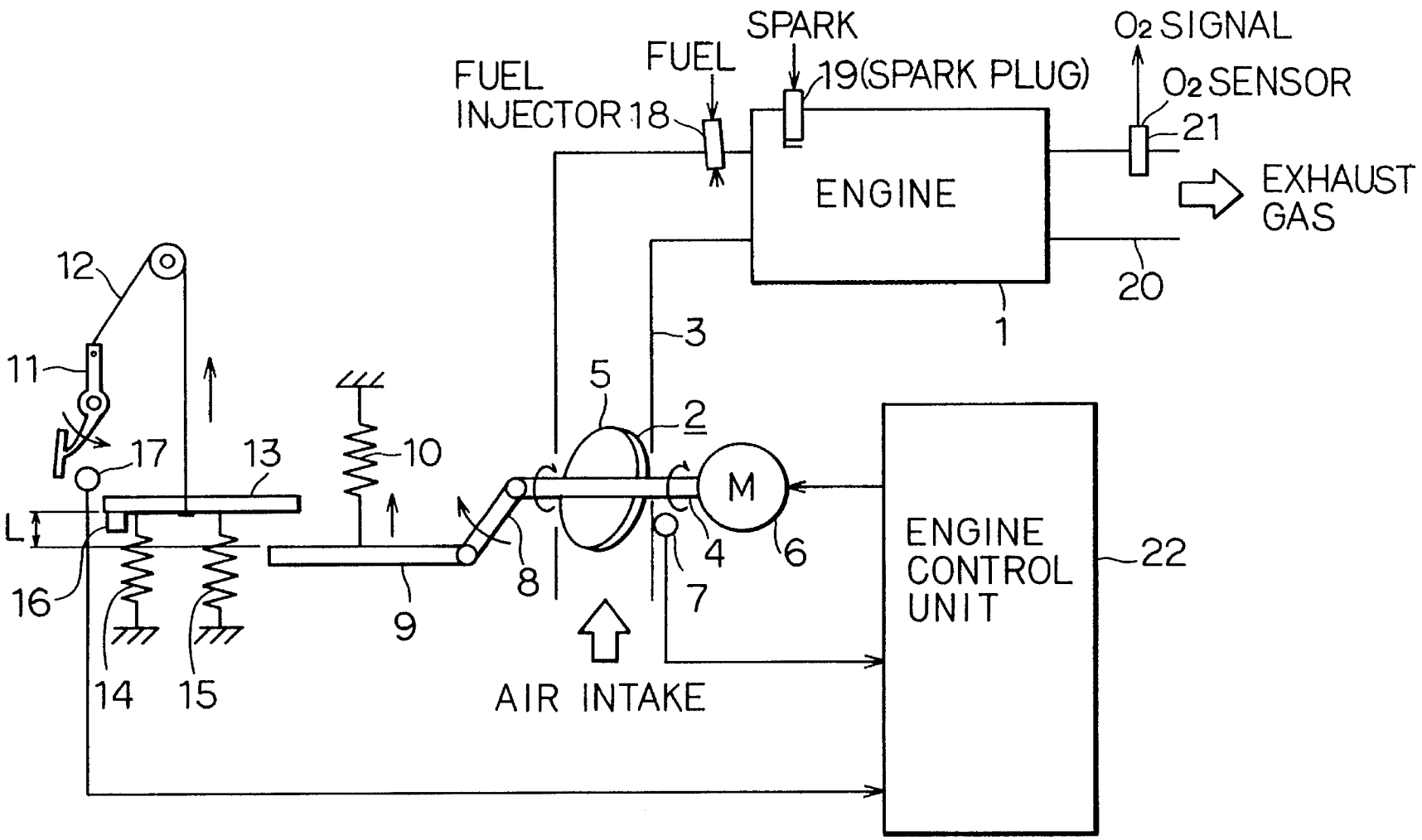
FIG. 1 illustrates the overall construction of an exemplary embodiment of an engine control apparatus according to the present invention.

FIG. 1 illustrates the intake and exhaust systems of a spark-ignition type engine 1 and the drive system of a butterfly-type throttle valve 2. The engine 1 is installed on a vehicle, and the output shaft of the engine 1 is drivingly connected to the wheels by a transmission. The throttle valve 2 includes a pivotable shaft 4 and a disc-shape valve body 5 fixed thereto and pivotably supported by intake pipe 3. The valve body 5 is conventionally disposed inside intake pipe 3 so as to regulate air flow into the engine combustion chambers by its opening.

The pivotable shaft 4 is driven by an electric motor 6 that serves as a throttle actuator regulating the opening of the throttle valve 2. The opening of the throttle valve 2 is detected by a throttle opening sensor 7.

The pivotable shaft 4 drives a cooperative member 9 via link member 8. The cooperative member 9 moves up and down (in the view of FIG. 1) as the throttle valve 2 pivots. The cooperative member 9 is provided with a spring 10 that urges throttle valve 2 toward the opening side (that is, in the opening direction). The arrows in FIG. 1 associated with members 4, 8, 9 and 12 indicate operational directions corresponding to opening of throttle valve 2.

An accelerator pedal 11 (e.g., an accelerator operating member) is fixed to an end of wire 12. The other end of the wire 12 is fixed to restricting member 13 which is provided with springs 14, 15 that urge the throttle opening restricting member 13 down (i.e., in a direction to close the throttle valve 2, the valve closing direction). Restricting member 13 thus is moved up and down (in the view of FIG. 1) by operating the accelerator pedal 11 against the elastic restoration force of springs 14, 15. When accelerator pedal 11 is in non-operated state (idle state), restricting member 13 stays in a position where it contacts a stop 16.

Restricting member 13 is disposed within the expected operational range of cooperative member 9. Thus, restricting member 13 restricts movement of cooperative member 9 toward the throttle valve opening side (that is, in the operating direction corresponding to an opening movement of throttle valve 2). More specifically, cooperative member 9 can relatively freely move until it contacts restricting member 13. Abutment of restricting member 13 on cooperative member 9 restricts cooperative member 9 from further moving toward the valve opening side (i.e., the force of spring 10 is less than that of combined springs 14, 15). Where restricting member 13 contacts stop 16, cooperative member 9 is allowed to move within a gap L from restricting member 13. The gap L is provided for regulating throttle valve 2 by electric motor 6 for control of intake air flow when accelerator pedal 11 is released, that is, ISC (idle speed control) and the like.

An accelerator sensor 17 detects the amount of accelerator pedal 11 operation, that is, accelerator depression.

Intake pipe 3 of engine 1 is provided with a fuel injection valve (i.e., injector) 18. By opening fuel injection valve 18, fuel is injected to engine 1. An ignition plug 19 is disposed in the combustion chamber of each cylinder of engine 1. The ignition plug 19 sparks to induce combustion in its respective combustion chamber at the appropriate time for that cylinder as will be appreciated.

An exhaust pipe 20 connected to engine 1 is provided with an $O_2$ sensor 21 that detects the oxygen concentration in the exhaust gas.

Figure 2:
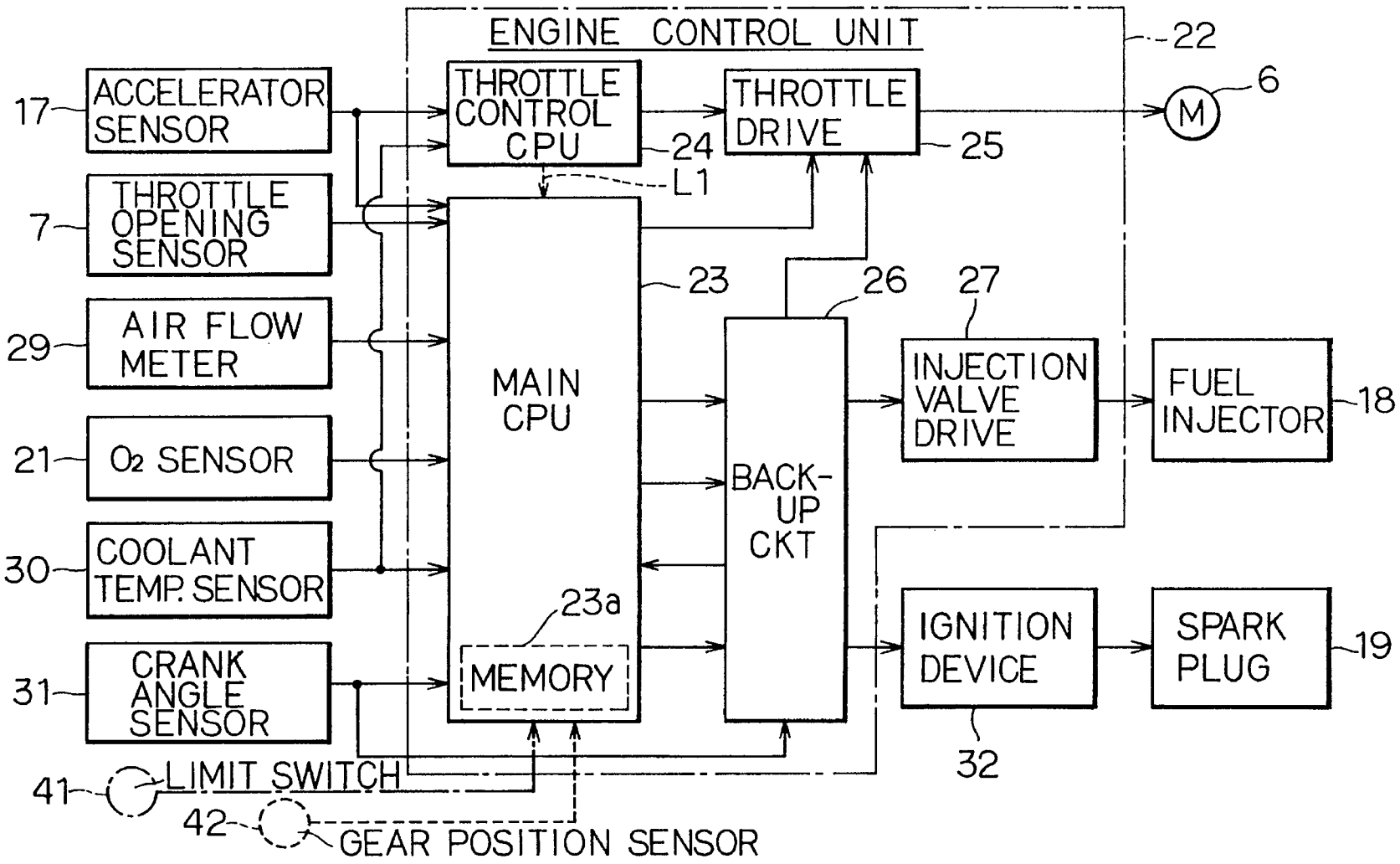
FIG. 2 is a diagram illustrating electrical construction of an ECU for engine control according to the embodiment of FIG. 1.

An engine controlling electronic control unit (ECU) 22 controls operation of throttle valve 2, fuel injection and injection timing. FIG. 2 illustrates an exemplary electrical construction for a suitable engine control ECU 22.

Referring to FIG. 2, the engine controlling ECU 22 includes a main CPU 23 serving as abnormality detector, actuator stop and output torque controller; a throttle control CPU 24 as throttle opening controller; a throttle drive circuit 25, a backup circuit 26; and injection valve drive circuit 27. Main CPU 23 is connected to accelerator sensor 17, throttle opening sensor 7, an air flow meter 29, $O_2$ sensor 21, a coolant temperature sensor 30 and a crank angle sensor 31. Main CPU 23 determines accelerator pedal 11 depression based on a signal from accelerator sensor 17, a throttle opening based on a signal from throttle opening sensor 7, an intake air flow based on a signal from air flow meter 29, an oxygen concentration in the exhaust gas based on a signal from $O_2$ sensor 21, the temperature of the engine coolant based on a signal from coolant temperature sensor 30, and a crank angle and an engine speed based on signal pulses from crank angle sensor 31.

Main CPU 23 is connected to injection valve drive circuit 27 by backup circuit 26. Injection valve drive circuit 27 is connected to fuel injection valve 18. Fuel injection valve 18 is controlled so as to inject an amount of fuel that is calculated by main CPU 23. Main CPU 23 is connected by backup circuit 26 to an ignition device 32 that is connected to ignition plug 19. Ignition plug 19 sparks at ignition timing that is calculated by main CPU 23.

Throttle control CPU 24 is connected to accelerator sensor 17 and also determines accelerator pedal 11 depression based on a signal from accelerator sensor 17. Throttle control CPU 24 is connected to coolant temperature sensor 30 and also determines the engine coolant temperature based on a signal from coolant temperature sensor 30. Further, throttle control CPU 24 output is also connected to throttle drive circuit 25, which is connected to electric motor 6. Throttle control CPU 24 calculates a throttle opening based on accelerator pedal 11 depression and, on the basis of that calculation, controls electric motor 6 to drive throttle valve 2. That is, throttle control CPU 24 drives an opening of throttle valve 2 in accordance with accelerator pedal 11 depression.

Figure 3:
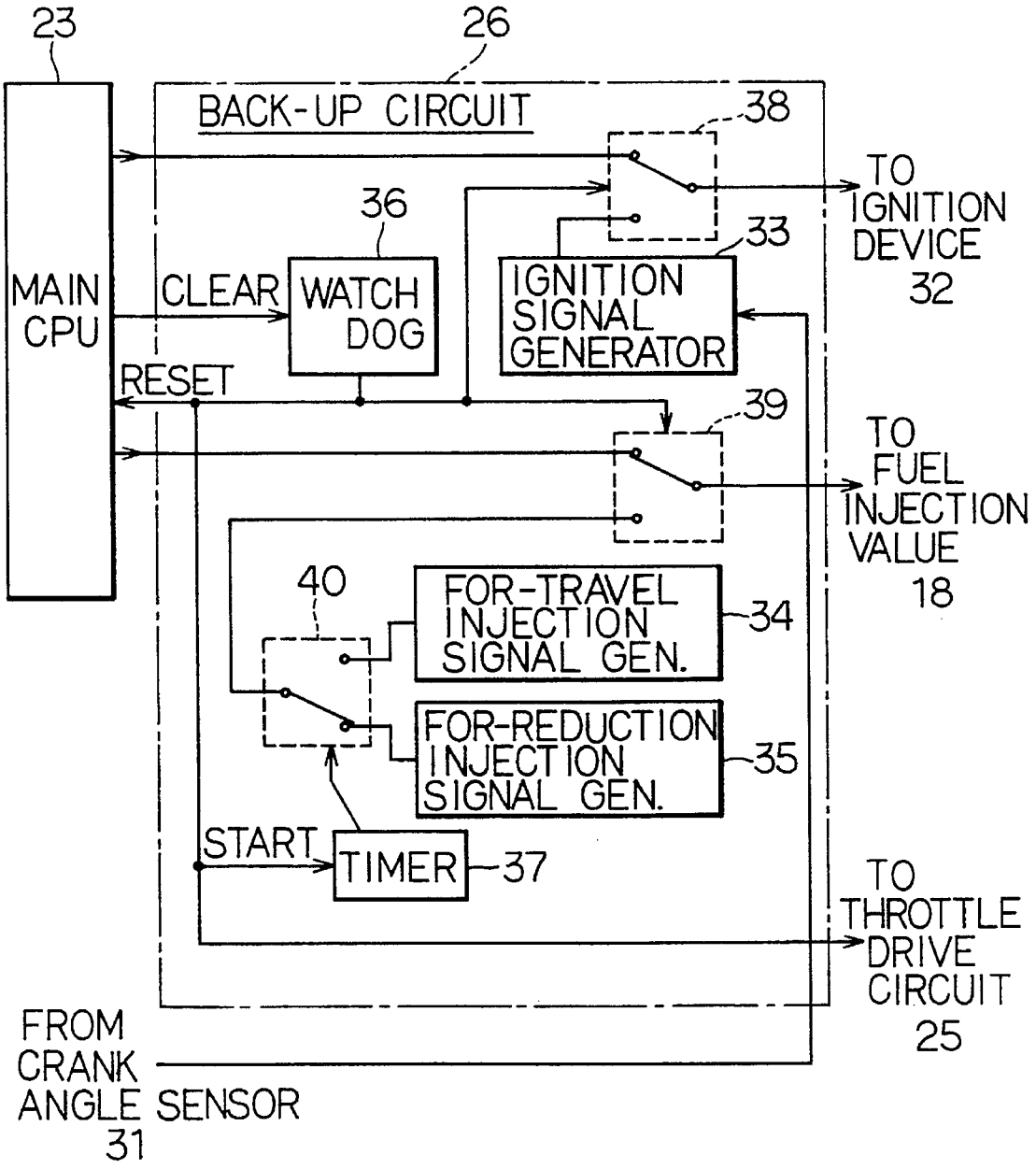
FIG. 3 is a diagram illustrating the electrical construction of a backup circuit for the embodiment of FIG. 2.

FIG. 3 illustrates the exemplary backup circuit 26 (preferably having a dedicated hardware construction). When an abnormality occurs in main CPU 23, backup circuit 26 replaces it to stop the driving of electric motor 6 and to control fuel injection and ignition timing.

Backup circuit 26 includes an ignition signal generating circuit 33, a "for-travel" injection signal generating circuit 34, a "for-reduction" injection signal generating circuit 35, a watch dog circuit 36, a timer circuit 37, and signal switching circuits 38, 39, 40 (which each may be electronic switch circuits). Ignition signal generating circuit 33 receives a signal from crank angle sensor 31 and accordingly generates an ignition signal. "For-travel" injection signal generating circuit 34 generates an injection signal sufficient to provide a minimum fuel amount for travelling. "For-reduction" injection signal generating circuit 35 generates an injection signal to provide a fuel amount less than the minimum fuel amount for travelling (provided by "for-travel" injection signal generating circuit 34). The reduction may be achieved by reducing an injection pulse width (corresponding to injection period) per injection or by omitting injections into cylinders.

Switch 38 transfers either an ignition signal from main CPU 23 or an ignition signal from ignition signal generating circuit 33 to ignition device 32. As long as main CPU 23 is normal, switch 38 transfers the ignition signal from CPU 23 to ignition device 32.

Switch 40 transfers a fuel injection signal from "for-travel" injection signal generating circuit 34 or a fuel injection signal from "for-reduction" injection signal generating circuit 35 to switch 39. As long as main CPU 23 is normal, switch 40 is set to transfer "for-reduction" injection signal generating circuit 35 output to switch 39. Switch 39 transfers either the fuel injection signal from main CPU 23 or the fuel injection signal from switch 40 to fuel injection valve 18. As long as main CPU 23 is normal, switch 39 transfers the fuel injection signal from main CPU 23 to fuel injection valve 18.

Watch dog circuit 36 constantly repeats its operation at a predetermined time interval. It is initialized to a preset count value (e.g., zero) by a watch dog clear signal from main CPU 23 so that the count value should not reach or exceed a predetermined value during normal operation of CPU 23. When the watch dog clear signal from main CPU 23 discontinues (so that the count value of watch dog circuit 36 reaches or exceeds a predetermined value), watch dog circuit 36 determines that an abnormality has occurred in main CPU 23, and outputs an abnormality detection signal to switch circuits 38, 39, timer circuit 37, throttle drive circuit 25, and main CPU 23. Thus, backup circuit 26 detects an abnormality by detecting missing expected signal pulses normally transmitted at regular intervals by main CPU 23 (abnormality detector, output torque controller).

Although according to this embodiment, main CPU 23 itself provides the abnormality detector and output torque controller, these devices also may be constituted by separate components. In such a case, abnormality detection may be based on signal pulses from the abnormality detector or signal pulses from the output torque controller.

Timer circuit 37 is started by an abnormality detection signal from watch dog circuit 36. When a predetermined length of time thereafter elapses, timer circuit 37 outputs a switch control signal to switch 40 so that the "for-travel" fuel injection signal from circuit 34 is transmitted to fuel injection valve 18 via switch 39.

Figure 4:
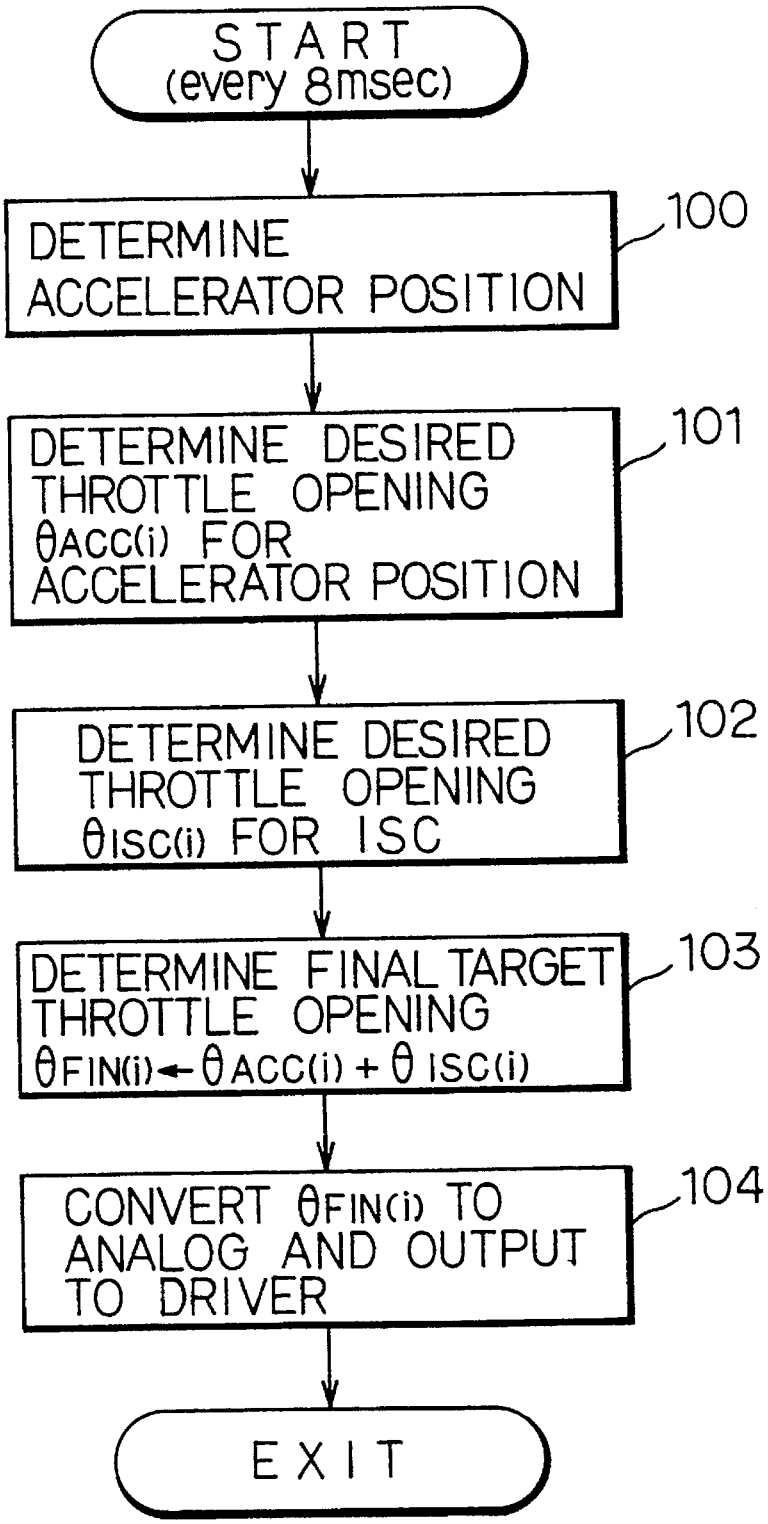
FIG. 4 is a flowchart illustrating engine control according to the illustrated exemplary embodiment.

FIG. 4 is a schematic control flowchart of the exemplary throttle control CPU 24 which is started (i.e., entered or called) at a regular interval of a predetermined length of time (e.g., 8 msec).

In step 100, throttle control CPU 24 takes in a signal from accelerator sensor 17 to determine current accelerator pedal 11 depression (position). At step 101, a throttle opening $\theta_{ACC(i)}$ signal value is determined corresponding to accelerator pedal 11 depression. (A subscript "i" indicates calculation timing. That is, whereas a current calculation cycle is indicated by i, the previous corresponding calculation cycle is indicated by i–1. The subscript i will indicate the same below).

At step 102, CPU 24 calculates a throttle opening $\theta_{ISC(i)}$ for ISC control (e.g., in accordance with the engine coolant temperature). At step 103, a final target throttle opening $\theta_{FIN(i)}$ is determined by adding the throttle opening $\theta_{ISC(i)}$ for ISC control to the throttle opening $\theta_{ACC(i)}$ corresponding to accelerator pedal 11 depression. At step 104, the final target throttle opening $\theta_{FIN(i)}$ is converted from digital-to-analog signal format and the resultant signal is output to the throttle drive circuit 25. As a result, the power supply to electric motor 6 is controlled to regulate throttle valve 2 to a final target throttle opening.

More specifically, if accelerator pedal 11 is depressed when throttle valve 2 is urged toward the valve opening side by spring 10, accelerator sensor 17 detects such operation of accelerator pedal 11. Then, throttle control CPU 24 determines a suitable desired opening for throttle valve 2 and accordingly controls electric motor 6 to operate throttle valve 2 to the desired predetermined opening. On the other hand, if accelerator pedal 11 is released (e.g., to enter an idling state), the opening of throttle valve 2 is controlled (that is, the intake air flow is controlled) within a limited range allowed by gap L between restricting member 13 and cooperative member 9 so as to perform proper ISC (idle speed control) to achieve a predetermined idle speed.

Figure 5:
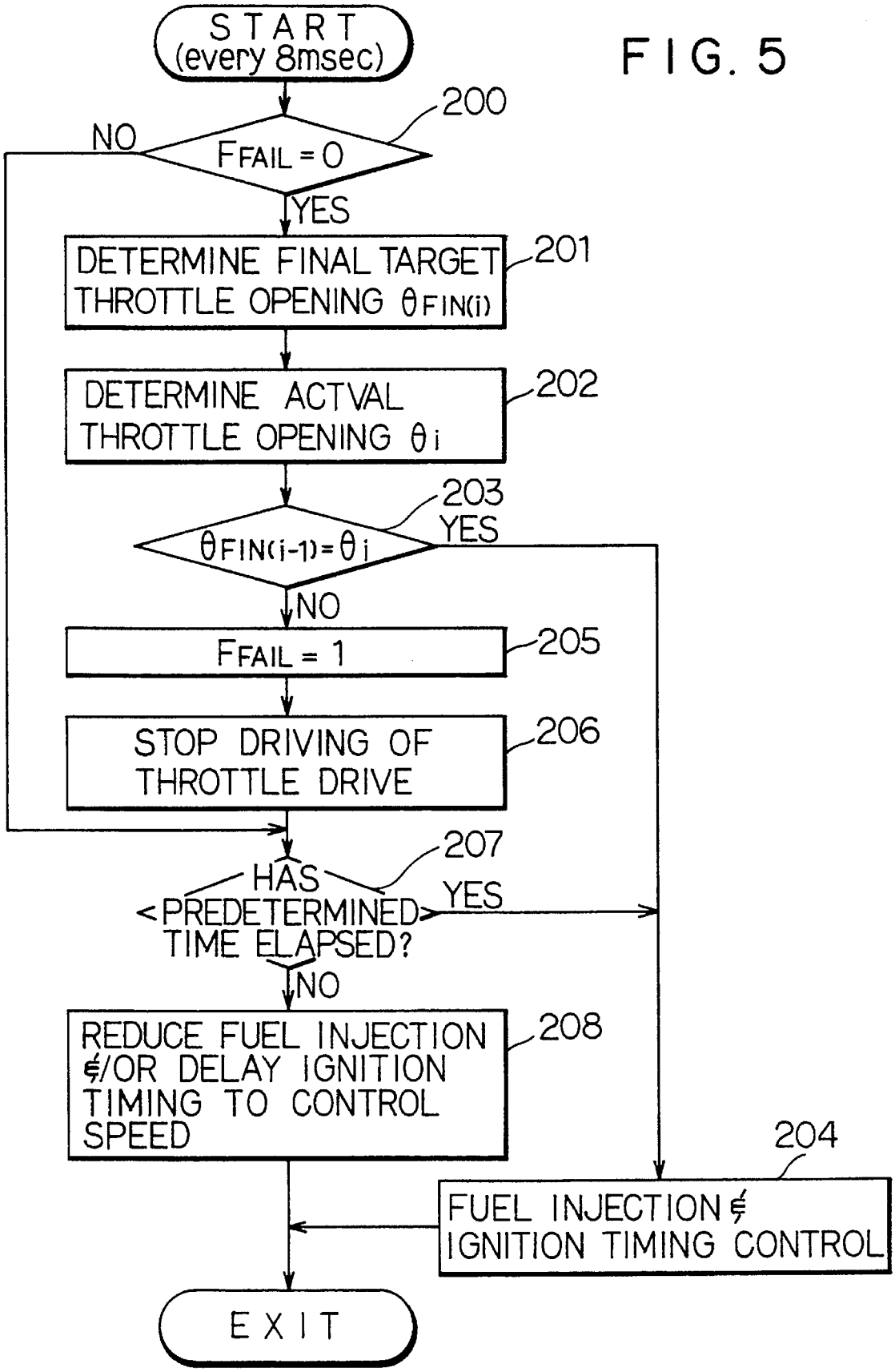
FIG. 5 is another flowchart illustrating engine control according to the illustrated exemplary embodiment.

FIG. 5 is an exemplary schematic flowchart of main CPU 23 operations which are conducted synchronously with those shown in FIG. 4 and also started at a predetermined time interval (e.g., 8 msec).

Main CPU 23 determines in step 200 whether an abnormality detection flag $F_{FAIL}$ has been set (e.g., to 1). The abnormality detection flag $F_{FAIL}$ indicates presence of a detected abnormality and is reset to $F_{FAIL}=0$ by suitable initialization upon turn on or otherwise. If $F_{FAIL}=0$, then main CPU 23, in step 201, takes in a signal from accelerator sensor 17 to accordingly determine current accelerator pedal 11 depression, a desired throttle opening $\theta_{ACC(i)}$ corresponding to accelerator pedal 11 depression, and a final desired target throttle opening $\theta_{FIN(i)}$ by adding the throttle opening $\theta_{ACC(i)}$ to the throttle opening $\theta_{ISC(i)}$ for ISC control. That is, main CPU 23 determines in step 201 the final target throttle opening $\theta_{FIN(i)}$ by signal processing similar to that of steps 100–103 in FIG. 4 of throttle control CPU 24.

Main CPU 23 also takes in the actual throttle opening $\theta_i$ by sampling throttle opening sensor 7 in step 202. At step 203, CPU 23 determines whether the actual throttle opening $\theta_i$ equals the previously determined final target throttle opening $\theta_{FIN(i-1)}$. If the control system operation using electric motor 6 has been normal, electric motor 6 should have been operated in accordance with the previous determined final target throttle opening $\theta_{FIN(i-1)}$ to reflect the final target throttle opening as the current actual throttle opening $\theta_i$.

If the actual throttle opening $\theta_i$ equals the previously determined final target throttle opening $\theta_{FIN(i-1)}$, main CPU 23 performs fuel injection control and ignition timing control in accordance with the normal engine operation in step 204. That is, main CPU 23 determines an amount of fuel to be injected in accordance with current engine speed, intake air flow, engine coolant temperature and exhaust gas oxygen concentration, and causes fuel injection valve 18 to inject fuel at predetermined timing. In addition, main CPU 23 determines ignition timing in accordance with current engine speed, intake air flow and engine coolant temperature, and causes ignition plugs 19 to accordingly spark at appropriate respective times during the engine cycle. CPU 23 then exits this routine.

However, if main CPU 23 determines in step 203 that actual throttle opening $\theta_i$ does not equal the previously determined final target throttle opening $\theta_{FIN(i-1)}$, main CPU 23 then determines that an abnormality has occurred (for example, a failure of throttle control CPU 24 or a failure of electric motor 6). Main CPU 23 then performs fail-safe processing in steps 205–208. Step 205 sets the abnormality detection flag $F_{FAIL}$ to 1. Step 206 stops the driving of throttle drive circuit 25 (e.g., to stop power supply to electric motor 6). That is, when an abnormality occurs, throttle drive circuit 25 stops the power supply to electric motor 6. As a result, throttle valve 2 (shown in FIG. 1) is turned towards the valve opening side by spring 10. Throttle valve 2 is mechanically restricted from further moving toward the valve opening side when cooperative member 9 abuts restricting member 13.

Main CPU 23 then determines in step 207 (FIG. 5) whether a predetermined length of time has elapsed following detection of the abnormality. In a first period, when the predetermined length of time has not yet elapsed, step 208 reduces fuel injection amounts and/or delays ignition timing thereby to reduce engine output torque so as to prevent an undesired temporary increase in engine speed despite the forced opening motion of throttle valve 2 (caused by the stopping of electric motor 6). In the next round of subroutine processing, the operation proceeds from step 200 to step 207 (since $F_{FAIL}=1$). Operation continues to branch to step 208 until step 207 determines that the predetermined length of time has elapsed. Steps 200, 207 and 208 are thus repeated for a while. When step 207 determines that the predetermined length of time has elapsed, operation thereafter repeatedly proceeds to step 204 (thereby finishing the reduction of fuel injection amounts and/or the delaying of ignition timing). Step 204 thereafter once again performs normal fuel injection and ignition operations. Thus, an increase in engine output torque (and speed) is curbed or suppressed despite the forced throttle valve opening motion (that continues from stopping of electric motor 6 until abutment of cooperative member 9 on restricting member 13).

The fuel injection amount may be reduced either: (a) by reducing the injection duration per performance or (b) by omitting selected injection performances. Main CPU 23 thus controls fuel injection amounts and ignition timing to control engine combustion in order to reduce fluctuation of output torque (that is, main CPU 23 provides a combustion controller).

Main CPU 23 may perform, as the combustion controller, one of the reducing and/or selective stopping of fuel injection. According to this embodiment, CPU 23 (actuator stop), cooperative member 9 and restricting member 13 constitute a fail-safe throttle opening regulator.

FIGS. 6A, 6B and 6C respectively indicates transition of the accelerator depression, the throttle opening and the engine speed during the idling. The depression of accelerator pedal 11 is constant since the engine is idling. The opening of throttle valve 2 is controlled to levels lower than that corresponding to the accelerator pedal depression by the ISC control until time t1 when an abnormality is detected. When an abnormality is detected, the power supply to electric motor 6 is stopped. In a period T2 between the power supply cut to electric motor 6 and the abutment of cooperative member 9 on restricting member 13, throttle valve 2 quickly opens by an amount corresponding to the gap L between the cooperative member 9 and restricting member 13. During such transitional operation, engine speed will temporarily increase and return to a stable level in a time T1, which may give a shock to the driver as indicated by a broken line 60 (a control example), unless special control for torque reduction is performed.

On the other hand, according to this exemplary embodiment, engine speed is kept substantially constant (as indicated by the solid line in FIG. 6C) by torque reducing processes, such as the fuel injection control or ignition control, that is performed by steps 205–208 in FIG. 5 during the predetermined length of time T1. The exemplary embodiment thus eliminates (or reduces) the possibility of giving a shock to the driver.

As described above, unless the torque reduction control is performed, when the power supply to electric motor 6 is stopped (so that the control operation enters a mechanical "limp home" mode), the engine speed may immediately increase by an amount corresponding to the gap L, which may give a shock to the driver. However, the exemplary embodiment of this invention curbs such an increase of the output engine torque by performing ignition control or fuel injection control during a predetermined length of time following the cutting of a power supply to electric motor 6.

The predetermined length of time T1, during which torque reduction processes are performed, is preferably greater than the predetermined length of time T2 between detection of an abnormality and abutment of cooperative member 9 on restricting member 13.

As for backup circuit 26 (FIG. 3), while main CPU 23 is operating normally, switch 38 is set to transmit ignition signals from main CPU 23 to ignition device 32. In addition, switch 39 is set to normally transmit fuel injection signals from main CPU 23 to fuel injection valve 18. Switch 40 is set to normally transmit fuel injection signals from "for-reduction" circuit 35 to switch 39.

If, in this normal situation, transmission of a watch dog clear signal from main CPU 23 to watch dog circuit 36 is stopped for any reason, the count value of watch dog circuit 36 reaches or exceeds a predetermined value so that watch dog circuit 36 transmits an abnormality detection signal to switches 38, 39, timer circuit 37, throttle drive circuit 25, and main CPU 23. Then, in response, throttle drive circuit 25 stops driving the throttle when the abnormality detection signal is received via backup circuit 26. Switches 38, 39 perform switch-over operation when receiving the abnormality detection signal. Timer circuit 37 also starts time counting in response to the abnormality detection signal. Main CPU 23 is also reset by the abnormality detection signal.

Thus, switch 38 thereafter transfers ignition signals from ignition signal generating circuit 33 to ignition device 32, which causes ignition plug 19 to spark. The fuel injection signal from "for-reduction" injection signal generating circuit 35 provides a fuel amount less than the minimum fuel amount for vehicle travelling, which is now transmitted to fuel injection valve 18 via switches 40, 39. This fuel injection signal then drives fuel injection valve 18 until the mode transition is completed.

Timer circuit 37 then outputs a switch-over signal to switch 40 when a predetermined length of time elapses (the predetermined length of time T1 indicated in FIG. 6).

As described above, even when an abnormality occurs in main CPU 23, ignition timing control and fuel injection control are performed to curb an increase in the engine speed that would otherwise be caused in such a situation.

In the subsequent mechanical throttle regulating mode (limp-home mode) for throttle valve 2, its opening is regulated by operating accelerator pedal 11 while cooperative member 9 contacts restricting member 13 (FIG. 1) so that restricting member 13 moves together with cooperative member 9. During the limp-home mode, vehicle-travelling may be performed (the mechanical throttle regulating mode provides sufficient fuel and ignition control vehicle-travelling).

Fuel injection skip control may be used to stop fuel injection into selected predetermined cylinders of a multi-cylinder engine at step 208 in FIG. 5, that is, to achieve controlled reduction of fuel injection amounts. Since a stoichiometric air-fuel ratio is maintained in each cylinder that receives a non-zero fuel injection in such a fuel injection skip control mode, it is a favorable output torque reduction method (e.g., considering the otherwise possibly adverse influence on exhaust gas emissions).

Figure 7:
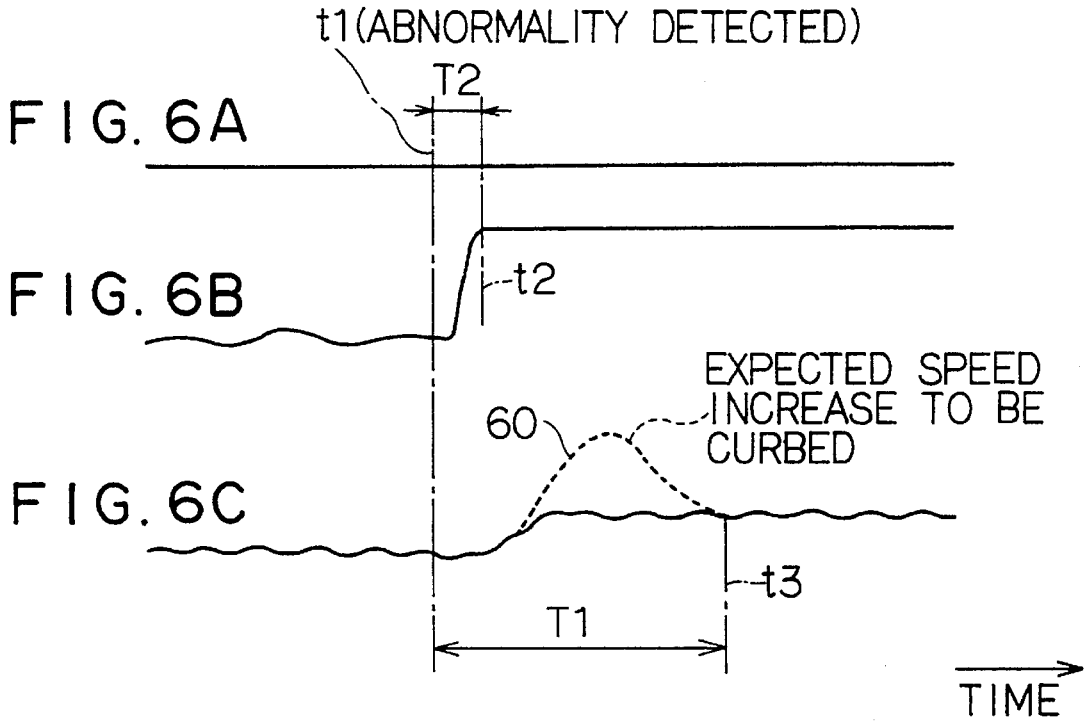
FIG. 7 shows a map indicating cylinders for which fuel injection is stopped in accordance with selected gear positions.

The exemplary engine 1 is an eight-cylinder gasoline engine employing multi-point injection in which a fuel injection valve is provided in each cylinder intake manifold. Memory 23*a* of main CPU 23 (FIG. 2) stores a map of fuel injection patterns in which fuel injection is selectively cancelled for certain cylinders (FIG. 7). The map determines which of the cylinders are omitted from fuel injection as a function of gear position (e.g., in a manual type of transmission provided in the engine power transmission system). In the map of FIG. 7, when the first or reverse gear position is selected, fuel injection for the first, third, fifth and seventh cylinders is omitted (ordinal numbers of the cylinders in FIG. 7 being in accordance with the order of fuel injection). When the second gear position is selected, fuel injection for the first, third and sixth cylinders is omitted. When the third gear position is selected, fuel injection for the first and fifth cylinders is omitted. When the fourth or fifth gear position is selected, fuel injection for the first cylinder is omitted.

Main CPU 23 receives a signal from gear position sensor 42 (FIG. 2) and thereby determines gear position (e.g., in the manual transmission type).

Figure 8:
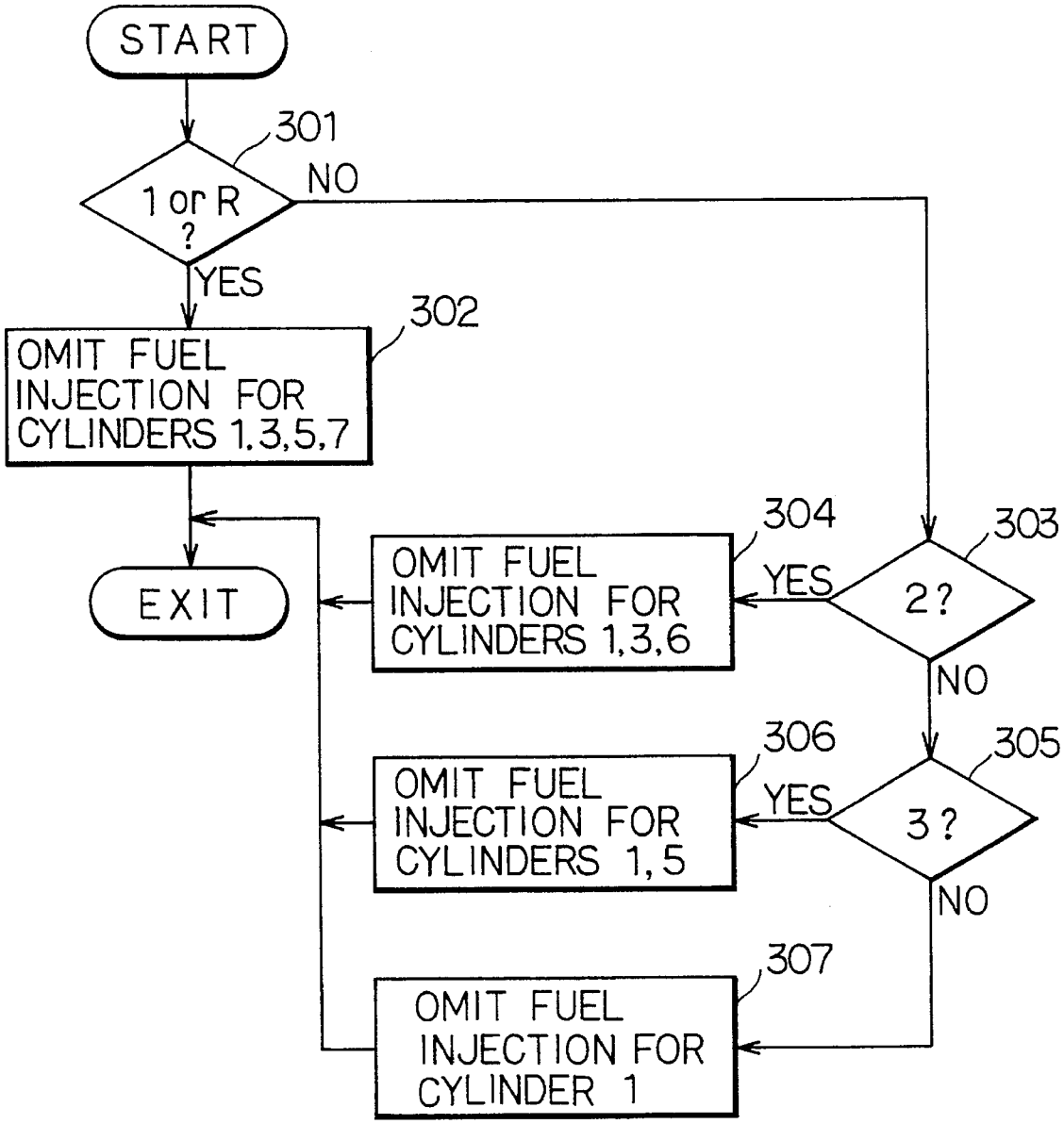
FIG. 8 is a flowchart illustrating the exemplary engine control as a function of detected gear position.
Figures 9A, 9B, 9C, 9D, 9E, 9F, 9G, 9H:
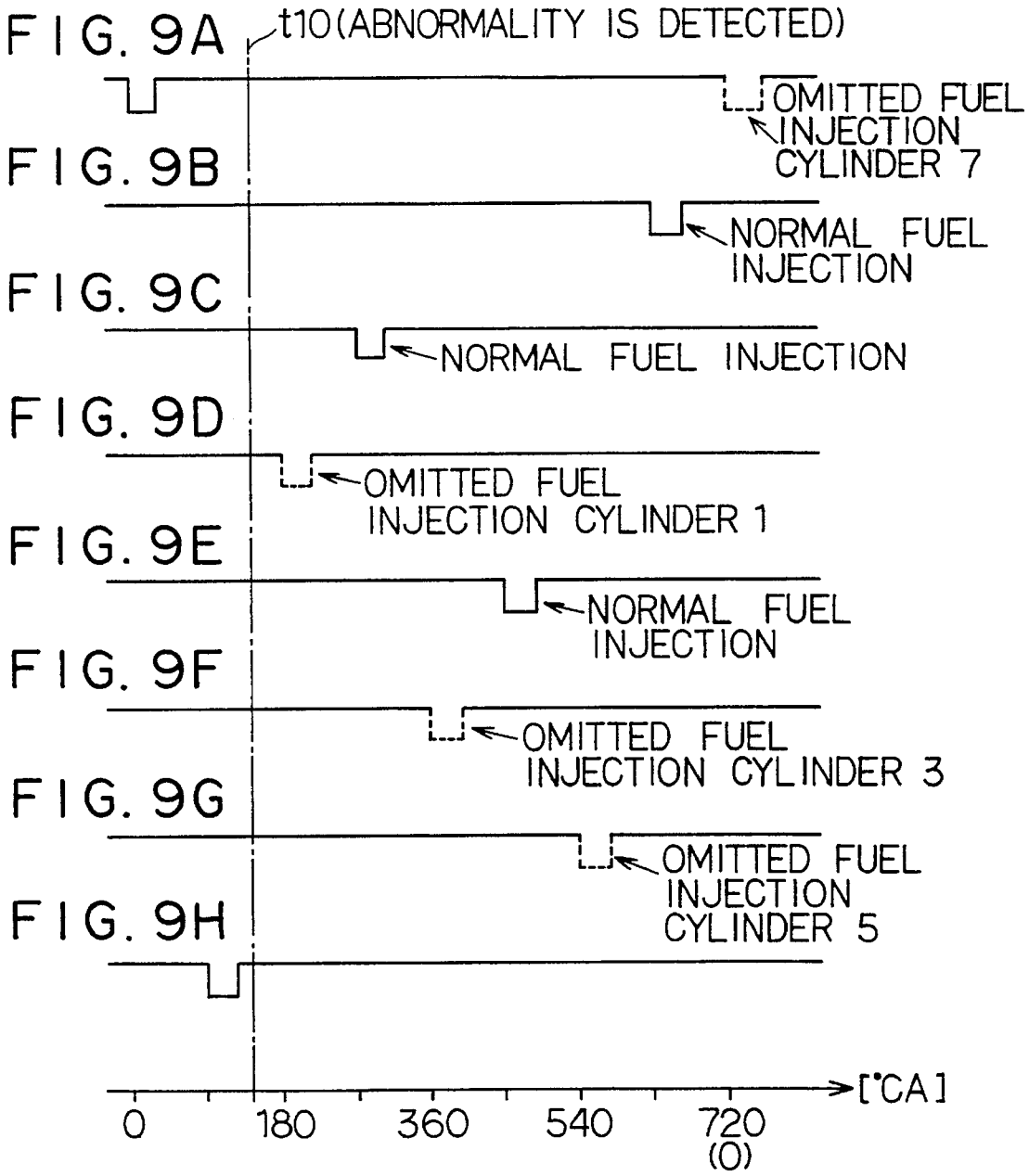
FIGS. 9A to 9H are timing charts for the exemplary engine control.

Main CPU 23 then may perform exemplary processing as illustrated in FIG. 8. Step 301 determines whether the first or reverse gear position has been selected. If the first or reverse gear position has been selected, step 302 causes fuel injection to be omitted in the first, third, fifth and seventh cylinders next to be encountered. Main CPU 23 thus instructs selective cancellation of fuel injection in the normal fuel injection sequence following an abnormality detection. More specifically, main CPU 23 forcibly sets "0" as the amount of fuel to be injected into those cylinders for which fuel injection is to be omitted, so that no fuel injected from the respectively corresponding fuel injection valves 18 (corresponding to the first, third, fifth and seventh cylinders) occurs even at fuel injection timing. As illustrated in FIGS. 9A–9H, if the first or reverse gear position is selected when a throttle abnormality is detected at time t10, fuel injection is thereafter cancelled for the first, third, fifth and seventh cylinders immediately after time t10 (that is, relative cylinder numbers 1, 3, 5 and 7 in terms of the normal fuel injection sequence following the detection of an abnormality).

If step 301 determines that the first or reverse gear position has not been selected, then step 303 determines whether the second gear position has been selected. If the second gear position has been selected, step 304 causes the first, third and sixth cylinders next to be encountered are to be omitted (i.e., see the map of FIG. 7). Main CPU 23 thus cancels fuel injection for the next encountered first, third and sixth cylinders according to the normal fuel injection sequence following detection of an abnormality.

If step 303 determines that the second gear position has not been selected, step 305 determines whether third gear position has been selected. If the third gear position has been selected, step 306 causes the next encountered first and fifth cylinders to be omitted from fuel injection (e.g., see the map of FIG. 7). Main CPU 23 thus cancels fuel injection for next encountered first and fifth cylinders etc in the normal fuel injection sequence following detection of an abnormality.

If step 305 determines that the third gear position has not been selected, main CPU 23 then determines that the fourth or fifth gear has been selected. Therefore, step 307 causes the next encountered first cylinder to be omitted from fuel injection (e.g., see the map of FIG. 7). Main CPU 23 thereby cancels fuel injection for the first cylinder next encountered according to the normal fuel injection sequence following detection of an abnormality.

Torque reduction processing is thus performed over a predetermined length of time T1 (for example, 200 ms) as indicated in FIG. 6C. More cylinders are omitted for lower speed gear positions, considering that lower speed gear positions transmit larger traction torques. That is, since higher gear ratios cause larger traction torques, more cylinders are omitted for higher gear ratios.

Figure 11:
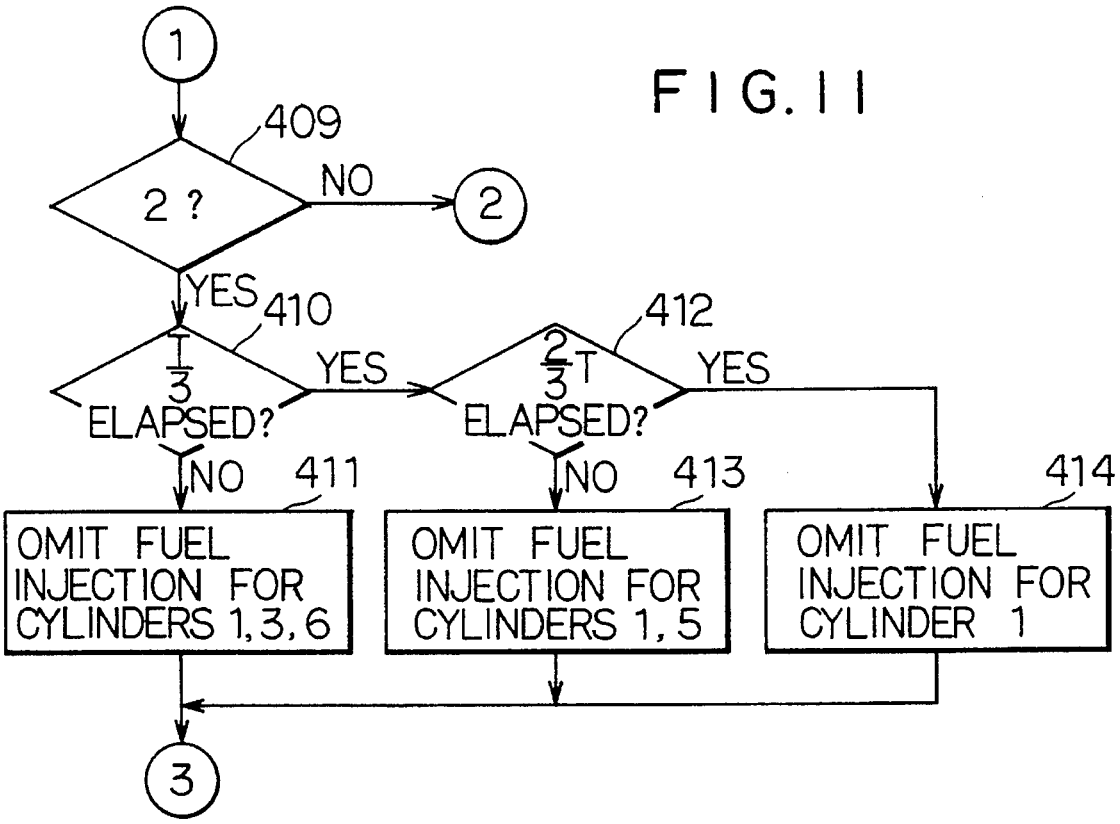
Figure 12:
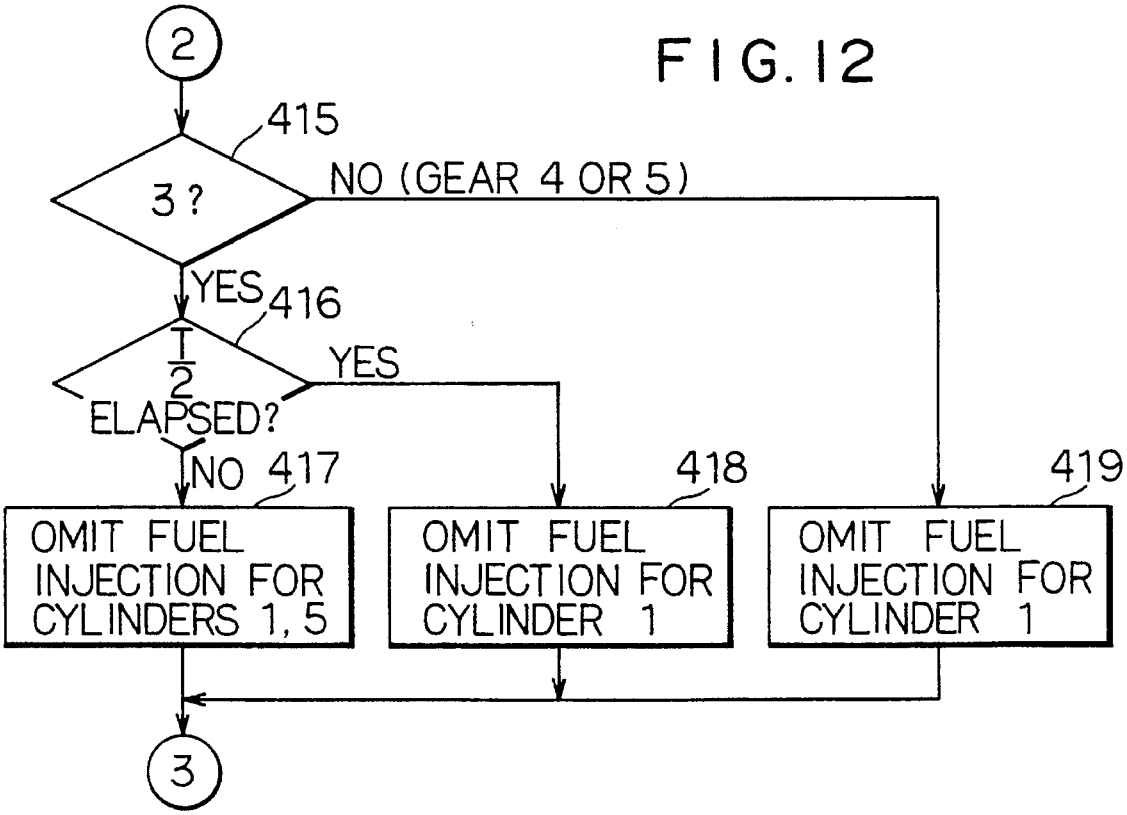
Figure 13:
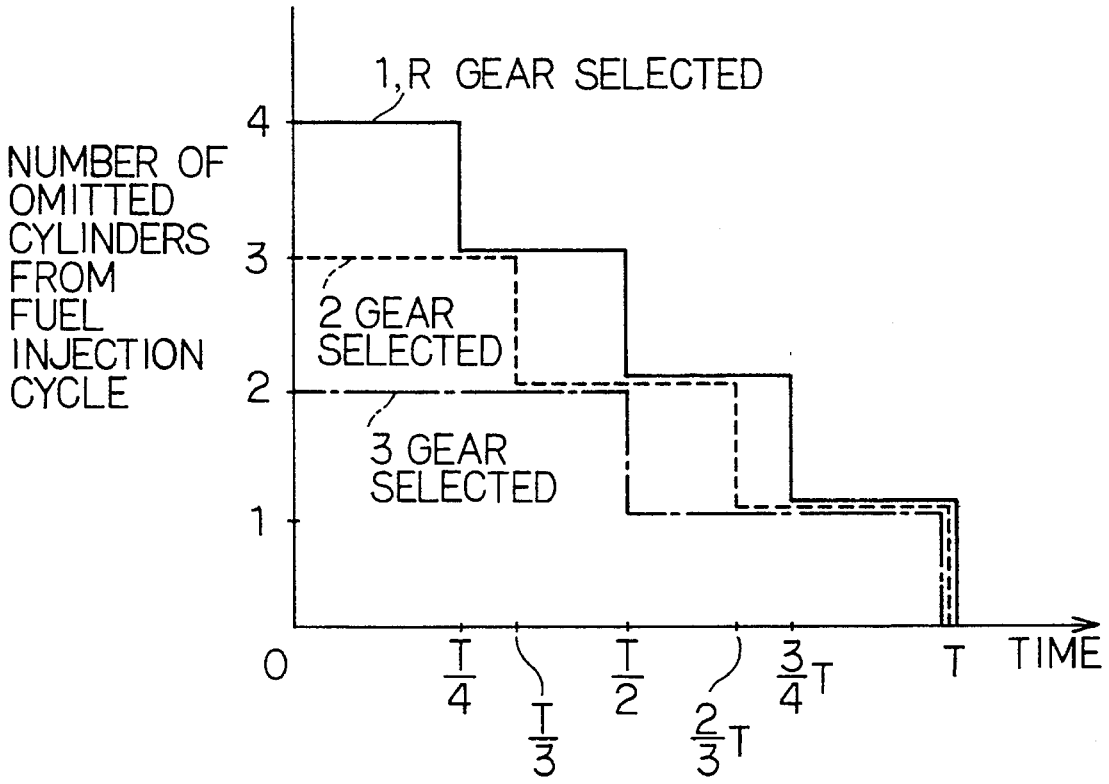
FIG. 13 is a graph illustrating the exemplary engine control of FIGS. 10–12.

A modification of the fuel injection skip control as illustrated in FIG. 13 cancels fuel injection for cylinders that are determined by gear position, and gradually reduces the number of omitted cylinders to finally return to the normal fuel injection control. Main CPU 23 may perform exemplary processing as illustrated in FIGS. 10–12 for the alternate embodiment which attains control mode of FIG. 13.

Figure 10:
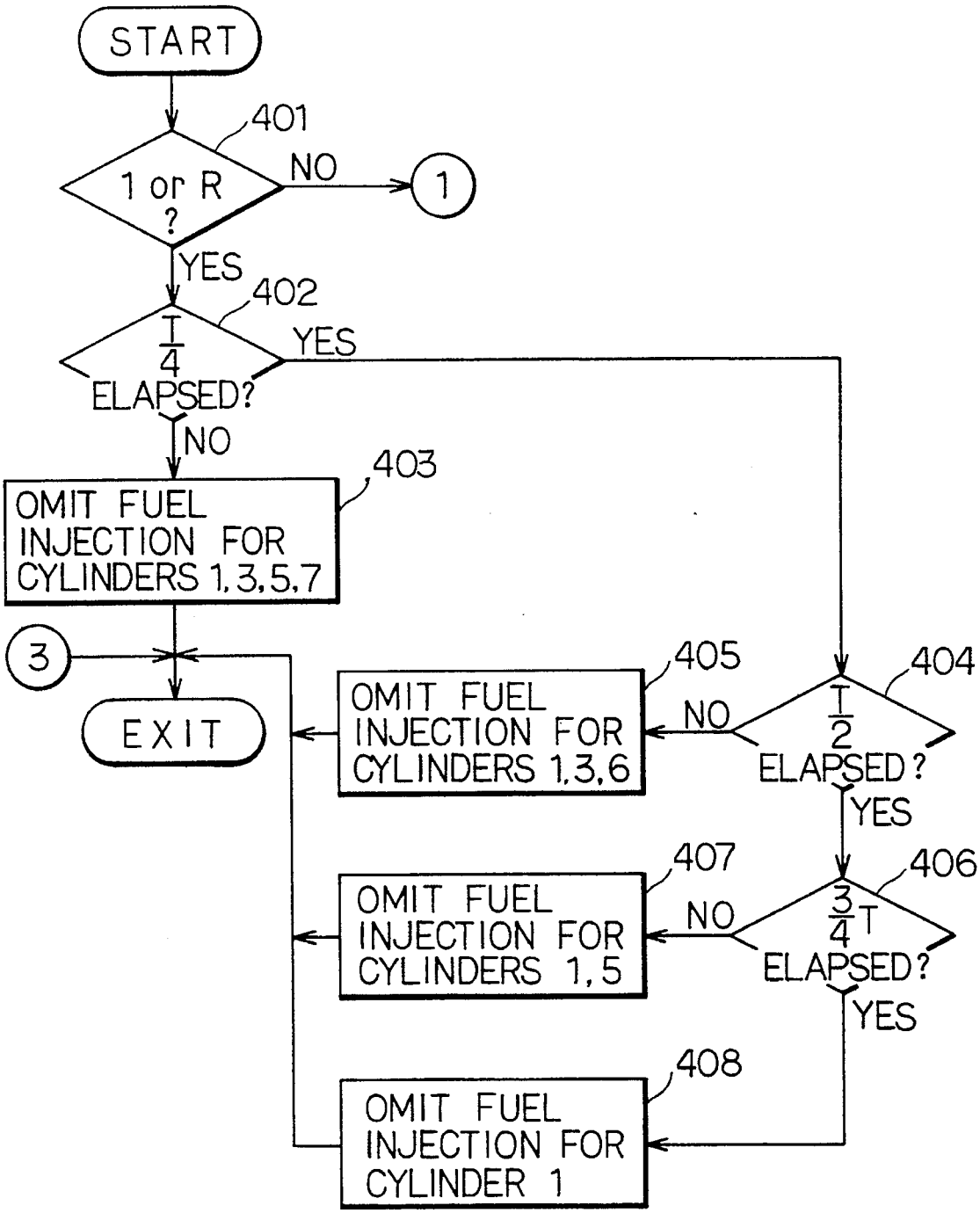
FIGS. 10–12 are flowcharts illustrating the exemplary engine control with a modified fuel injection skipping type of control during a transition to manual fail-safe mode.

Step 401 in FIG. 10 determines whether the first or reverse gear position has been selected. If the first or reverse gear position has been selected, step 402 determines whether a quarter of a predetermined length of time T (corresponding to the predetermined length of time T1 indicated in FIGS. 6A–6C) has elapsed. If it has not elapsed, step 403 causes the next encountered first, third, fifth and seventh cylinders (etc) to be omitted from fuel injection (e.g., see the map of FIG. 7). Main CPU 23 thereby cancels fuel injection for the first, third, fifth and seventh cylinders next encountered according to the normal fuel injection sequence following detection of an abnormality. More specifically, main CPU 23 forcibly sets "0" as the amount of fuel to be injected into those cylinders, so that no fuel is injected from fuel injection valves 18 corresponding to the next encountered first, third, fifth and second cylinders (etc) when the injection timing for each of the cylinders occurs.

If step 402 determines that T/4 has elapsed, step 404 determines whether half the predetermined length of time T (corresponding to the predetermined length of time T1 indicated in FIGS. 6A–6C) has elapsed. If it has not elapsed, step 405 causes the next encountered first, third and sixth cylinders to be omitted (the second pattern in FIG. 7). That is, main CPU 23 cancels fuel injection for the first, third and sixth cylinders next encountered according to the normal injection sequence following the detection of abnormality.

If step 404 determines that T/2 has elapsed, then step 406 determines whether ¾ of the predetermined length of time T (corresponding to T1 indicated in FIGS. 6A–6C) has elapsed. If it has not elapsed, step 407 causes the first and fifth cylinders to be omitted from fuel injection (the third pattern in FIG. 7). Main CPU 23 thus cancels fuel injection for the first and fifth cylinders next encountered according to the normal injection sequence following detection of an abnormality.

If step 406 determines that 3T/4 has elapsed, step 408 causes only the first cylinder to be omitted from fuel injection (the fourth pattern in FIG. 7). Main CPU 23 thus cancels fuel injection for the first cylinder next encountered according to the normal injection sequence following detection of an abnormality.

If step 402 determines that the first or reverse gear position has not been selected, the operation goes to step 409 in FIG. 11 to determine whether the second gear position has been selected. If the second gear position has been selected, step 410 determines whether ⅓ of the predetermined length of time T (T/3; T being corresponding to T1) has elapsed. If it has not elapsed, step 411 causes fuel injection for the next encountered first, third and sixth cylinders to be omitted (the second pattern in FIG. 7). Main CPU 23 thus cancels fuel injection for the first, third and sixth cylinders (etc) next encountered according to the normal injection sequence following detection of an abnormality.

If step 410 determines that T/3 has elapsed, step 412 determines whether ⅔ of the predetermined length of time T (corresponding to T1 in FIG. 6) has elapsed. If it has not elapsed, step 413 causes fuel injection for the next encountered first and fifth cylinders to be omitted (the third pattern in FIG. 7). Main CPU 23 thus cancels fuel injection for the first and fifth cylinders next encountered according to the normal injection sequence following detection of an abnormality. If step 412 determines that 2T/3 has elapsed, step 414 causes fuel injection to be omitted for the next encountered first cylinder (the fourth pattern in FIG. 7). Main CPU 23 thus cancels fuel injection for the first cylinder next encountered according to the normal injection sequence following detection of an abnormality.

If step 409 determines that the second gear position has not been selected, the operation goes to step 415 in FIG. 12 to determine whether the third gear position has been selected. If the third gear position has been selected, step 416 determines whether half the predetermined length of time T (corresponding to T1) has elapsed. If it has not elapsed, step 417 causes fuel injection for the first and fifth cylinders to be omitted (the third pattern in FIG. 7). Main CPU 23 thus cancels fuel injection for the first and fifth cylinders next encountered according to the normal injection sequence following detection of an abnormality.

If step 416 determines that T/2 has elapsed, step 418 causes fuel injection for the first cylinder to be omitted (the fourth pattern in FIG. 7). Main CPU 23 thus cancels fuel injection for the first cylinder next encountered according to the normal injection sequence following detection of an abnormality.

If step 415 determines that the third gear position has not been selected, main CPU 23 has effectively determined that the fourth or fifth gear position has been selected. Therefore, step 419 causes fuel injection for the first cylinder to be omitted (e.g., see the map of FIG. 7). Main CPU 23 thus cancels fuel injection for the first cylinder next encountered according to the normal injection sequence following detection of an abnormality.

Torque reduction processing is thereby performed over the predetermined length of time T1 indicated in FIGS. 6A–6C, by gradually reducing the number of cylinders from which fuel injection is omitted, that is, by sequentially using the control patterns indicated in FIG. 7. Thus, fuel injection skip control is smoothly shifted to normal fuel injection control.

According to this embodiment, main CPU 23 determines whether an abnormality has occurred in the throttle opening control system (more specifically, accelerator sensor 17, electric motor 6 and the throttle control CPU 24) in steps 201–203 in FIG. 5. If an abnormality is detected, main CPU 23 controls the amount of fuel to be injected into engine 1 (and ignition timing of engine 1) so as to curb an increase in output torque (otherwise caused by the opening action of throttle valve 2 after the driving of electric motor 6 is stopped until restricting member 13 abuts cooperative member 9). Therefore, if an abnormality occurs, an increase in the output torque of engine 1 is curbed, and an abrupt increase in engine speed is prevented. As a result, the throttle operation smoothly shifts from an electronic regulation mode to a mechanical regulation mode (fail-safe mode) and shocks to the driver are reduced.

According to the present exemplary embodiment, a fail-safe control system is provided separately from the normal throttle control system. Therefore, if an abnormality occurs in electric motor 6, throttle control CPU 24 or the like, the exemplary embodiment nevertheless achieves a smooth shift to the mechanical regulation mode. Using the throttle opening control system and various vehicle-installed actuators, such as fuel injection valves (injectors) or igniters, the exemplary embodiment achieves a smooth shift to the mechanical regulation mode if an abnormality occurs in the throttle opening control system.

In addition, main CPU 23 operates to curb an increase in the output torque during a predetermined length of time following detection of an abnormality without requiring a complicated construction. If engine 1 is installed in a vehicle, the curbing of an undesired output torque increase significantly prevents changes of vehicle behavior and allows for shifting to a mechanical throttle control mode at an earlier time.

Furthermore, backup circuit 26 detects an abnormality in main CPU 23 (serving as the abnormality detector and output torque controller). When detecting an abnormality, backup circuit 26 stops driving of electric motor 6 and generates ignition timing, reduced fuel injection, a "for-travelling" fuel injection signal to control fuel injection and ignition timing. Therefore, if an abnormality occurs in main CPU 23 (so that CPU 23 fails to detect an abnormality and to perform fuel injection control and ignition timing control), fuel injection control and ignition timing control are nevertheless continued so as to curb an undesired engine speed increase. As a result, even if main CPU 23 fails, a shift to a mechanical control mode is still performed while controlling torque fluctuation.

Further, main CPU 23 may perform fuel injection skip control to cancel fuel injection for predetermined cylinders of a multi-cylinder engine as illustrated in FIG. 8, thereby curbing an undesired engine output torque increase without degrading exhaust emission quality. More specifically, the fuel injection amount for non-omitted cylinders is still determined so that the air-fuel ratio remains close to a target air-fuel ratio (that is, the stoichiometric ratio (A/F =14.7) for the target air-fuel ratio control (normal control), and a target air-fuel ratio for a lean burn control), the exemplary embodiments curb undesired engine output increases without degrading emission quality.

Main CPU 23 determines the number of cylinders to be omitted in accordance with currently selected gear position in the engine power transmission train. Thus, engine output increases are curbed taking account of the fact that output torque from the transmission varies depending on the transmission gear position.

Since main CPU 23 gradually reduces the number of cylinders from which fuel injection is omitted (e.g., as in steps 402–408 in FIG. 10), a smooth shift from fuel injection skip control to the normal fuel injection control is achieved.

Since main CPU 23 preferably determines cylinders to omit from fuel injection so that the omitted cylinders are distributed evenly with respect to the normal fuel injection sequence, operational fluctuation of the engine 1 that occurs in each cycle is reduced, thus achieving smooth engine control. That is, omittance of fuel injection from immediately successive cylinders is avoided, as indicated in the map of FIG. 7. If four cylinders are to be omitted, the first, third, fifth and seventh cylinders are omitted. If three cylinders are to be omitted, the first, third and sixth cylinders are omitted. If two cylinders are to be omitted, the first and fifth cylinders are omitted.

Furthermore, main CPU 23 may gradually reduce the number of cylinders from which fuel injection is omitted, in regular cycles. That is, the predetermined length of transition time T may be divided into equal periods and the number of cylinders to omit may be reduced by one for every equal period as in steps 402, 404 and 406 in FIG. 10. Thus, since the number of omitted cylinders is gradually reduced every time period, a smooth shift from the fuel injection skip control to a normal fuel injection control is achieved.

In addition, main CPU 23 may determine the number of omitted cylinders in accordance with vehicle-running conditions (e.g., selected gear positions). Since the torque control is achieved as a function of the running conditions at the time of detecting an abnormality (or a little before or after the time of detection), adverse effects on vehicle running are reduced, (considering that the influence of fuel injection skip control on vehicle running behavior changes depending on vehicle running conditions if the omitted cylinders are the same).

Main CPU 23 may always detect or monitor vehicle running conditions (e.g., gear position) and store the detection results in memory. Therefore, data regarding vehicle running conditions a little before or after detection of an abnormality may be already at hand and ready for immediate use for controlling undesired torque increases.

In short, using transmission gear position to monitor vehicle running conditions, main CPU 23 (the output torque controller) performs torque increase control in accordance with the running conditions at the time of detecting an abnormality (or a little before or after the time of detection), where the influence of a single mode of torque increase control on vehicle running behavior changes depending on running conditions.

Although the exemplary embodiments use transmission gear position as a detection factor corresponding to vehicle running conditions, vehicle speed or accelerator depression may instead be used as such a detection factor so that fuel injection reduction or ignition timing adjustment is determined in accordance with the magnitude of vehicle velocity or acceleration, or the like. In short, the torque control during mode transition (e.g., the number of cylinders to be omitted from fuel injection) is reduced as the vehicle speed increases. Furthermore, a suitable combination of gear position, vehicle speed and/or accelerator depression may be used as a reference for controlling undesired output torque increases.

Many other modifications may be made in this invention, a few of which are detailed below:

1. Although the exemplary embodiments start curbing engine output torque a predetermined length of time after detecting an abnormality, the engine control apparatus may employ a limit switch 41 for detecting contact of restricting member 13 with cooperative member 9 (as indicated by two-dot lines in FIG. 2), so that main CPU 23 starts curbing engine output torque when detecting contact of restricting member 13 and cooperative member 9 (corresponding to the time t2 in FIG. 6). This construction makes it possible to start the output torque control at a time more suitable to the specifications of a particular engine (or the magnitude of the opening force acting on throttle valve 2).

The contact detector can be provided in a simple construction by forming restricting member 13 and cooperative member 9 from electrically conductive materials so that contact therebetween can be detected by an electrical current that flows therebetween upon contact.

2. Although the exemplary embodiments perform fuel injection reduction control and ignition timing delay when a mode shift is induced by detection of an abnormality by main CPU 23, the engine control apparatus may perform only one of those controls.

3. Although the exemplary embodiments only perform reduction control when operation is shifted to the mechanical mode by backup circuit 26, the engine control may perform only ignition timing delay control or both reduction control and ignition timing delay control.

4. The engine control apparatus may be used with an engine arrangement employing an accelerator lever instead of accelerator pedal 11 as the accelerator operating member.

5. Electric motor 6 as the throttle actuator may be replaced by other types of actuators such as a hydraulic motor.

6. Although the exemplary embodiment determines in step 203 in FIG. 5 that an abnormality has occurred if the target throttle opening differs from the actual throttle opening, the engine control apparatus may be constructed to detect abnormalities separately for throttle control CPU 24, electric motor 6 and accelerator sensor 17 so that when detecting an abnormality in any one of those units, the apparatus stops electric motor 6 and shifts operation to the mechanical mode. According to the invention, the shift to the mechanical fail-safe mode is induced by detection of an abnormality in at least one of: (a) accelerator sensor 17, (b) electric motor 6 and (c) throttle control CPU 24 (throttle opening controller).

7. Abnormality detection may be performed by using data communication between throttle control CPU 24 and main CPU 23 through a communication link L1 therebetween (as indicated in FIG. 2). In this construction, throttle control CPU 24 transmits the result of the throttle opening computation illustrated in FIG. 4 to main CPU 23, which then compares the results with the result of the throttle opening computation in step 201 in FIG. 5. If those results do not agree, main CPU 23 determines that an abnormality has occurred in throttle control CPU 24 and thus shifts operation to the mechanical fail-safe mode. In short, detection of an abnormality in the throttle opening control system may be performed by the main CPU 23 (the abnormality detector) by calculating a throttle valve opening in accordance with the accelerator depression detected by accelerator sensor 17, and comparing the calculation result with the throttle valve opening calculated by throttle control CPU 24.

While the present invention has been described with reference to what is presently considered to be preferred exemplary embodiments, it is to be understood that the invention is not limited to the disclosed embodiment. To the contrary, the invention is intended to cover all modifications and equivalent arrangements included within the spirit and scope of the appended claims.

What is claimed is:

1. An engine control apparatus comprising:

a throttle valve provided in an intake passage of an engine and urged in the valve opening direction;

an accelerator sensor that detects the position of an accelerator operating member;

a throttle actuator that regulates an opening of the throttle valve;

throttle opening controller for driving the throttle actuator to control the opening of the throttle valve in accordance with the accelerator operating member position detected by the accelerator sensor;

abnormality detecting means for detecting an abnormality occurring in at least one of the accelerator sensor, the throttle actuator and the throttle opening controller;

actuator stopping means for stopping the driving of the throttle actuator if the abnormality detecting means detects an abnormality;

a cooperative member movable with the throttle valve;

a restricting member mechanically connected to the accelerator operating member and movable to a position corresponding to the accelerator operating member position so that when the driving of the throttle actuator is stopped, the restricting member contacts the cooperative member to restrict the throttle valve from further moving toward a valve opening, and thus regulates opening of the throttle valve in accordance with the accelerator operating member position while remaining in contact with the cooperative member; and output torque controller for, at the time of abnormality detection by the abnormality detecting means, controlling at least one of an amount of fuel to be injected into the engine and ignition timing so as to curb an engine output torque increase otherwise caused by valve opening movement performed after driving of the throttle actuator is stopped until the restricting means contacts the cooperative member.

2. An engine control apparatus according to claim 1, wherein the output torque controller performs a torque increase curbing operation in accordance with running conditions of a vehicle in which the engine is installed.

3. An engine control apparatus according to claim 1, wherein the restricting member is disposed a predetermined distance apart from the cooperative member at predetermined conditions, and wherein the restricting member contacts the cooperative member when the driving of the throttle actuator is stopped at the time of abnormality detection.

4. An engine control apparatus according to claim 1, wherein the output torque controller curbs an output torque increase during a predetermined length of time following abnormality detection.

5. An engine control apparatus according to claim 1, wherein the abnormality detecting means detects an abnormality by determining a desired opening of the throttle valve in accordance with the accelerator operating member position detected by the accelerator sensor, and comparing the desired opening of the throttle valve with an actual opening of the throttle valve determined by the throttle opening controller.

6. An engine control apparatus according to claim 1, further comprising:

a throttle opening sensor that detects an opening of the throttle valve, the abnormality detecting means detecting an abnormality by determining a desired opening of the throttle valve in accordance with the accelerator operating member position detected by the accelerator sensor, and comparing the desired opening of the throttle valve with an actual opening of the throttle valve detected by the throttle opening sensor.

7. An engine control apparatus according to claim 4, wherein said predetermined length of time is greater than the length of time between the abnormality detection and the contacting of the restricting member and the cooperative member.

8. An engine control apparatus according to claim 1, further comprising:

contact detector for detecting the contacting of the restricting member and the cooperative member, the output torque controller starting to curb an output torque increase when the contact detector detects the contacting of the restricting member and the cooperative member.

9. An engine control apparatus according to claim 8, wherein the contact detector detects said contacting by detecting an electric current flowing between the restricting member made of an electrically conductive material and the cooperative member made of an electrically conductive material when the restricting member and the cooperative member contact.

10. An engine control apparatus according to claim 1, further comprising:

backup means for, if an abnormality is detected in at least one of the abnormality detecting means and the output torque controller, stopping the driving of the throttle actuator and controlling at least one of an amount of fuel to be injected into the engine and ignition timing so as to curb an engine output torque increase otherwise caused by a valve opening movement performed after the driving of the throttle actuator is stopped until the restricting means contacts the cooperative member.

11. An engine control apparatus according to claim 10, wherein the backup means detects an abnormality in at least one of the abnormality detecting means and the output torque controller on the basis of a pulse signal outputted at a predetermined time interval by at least one of the abnormality detecting means and the output torque controller.

12. An engine control apparatus according to claim 1, wherein the output torque controller performs fuel injection skip control for stopping fuel injection for predetermined cylinders of a multi-cylinder engine so as to curb an engine output torque increase.

13. An engine control apparatus according to claim 12, wherein the output torque controller determines the number of cylinders in which to omit fuel injection in the fuel injection skip control, in accordance with running conditions of a vehicle in which the engine is installed.

14. An engine control apparatus according to claim 13, wherein at least one of gear position in a transmission disposed in an engine power transmitting system, vehicle speed, and accelerator operation amount is used as a detection factor corresponding to said running conditions.

15. An engine control apparatus according to claim 14, wherein the output torque controller increases the number of cylinders to omit for a lower speed gear position selected.

16. An engine control apparatus according to claim 12, wherein the output torque controller gradually reduces the number of cylinders to omit when the torque control shifts from fuel injection skip control to normal fuel injection control.

17. An engine control apparatus according to claim 12, wherein the output torque controller selects cylinders to omit from fuel injection so that the omitted cylinders are substantially evenly distributed with respect to a combustion sequence of all the cylinders.

18. An engine control apparatus according to claim 16, wherein the output torque controller gradually reduces the number of omitted cylinders at a regular cycle of elapsed times.

19. An engine control apparatus comprising:

a throttle valve provided in an intake passage of an engine and urged in the valve opening direction;

an accelerator sensor that detects the position of an accelerator operating member;

a throttle actuator that regulates an opening of the throttle valve;

throttle opening controller for driving the throttle actuator to control the opening of the throttle valve in accordance with the position of the accelerator operating member detected by the accelerator sensor;

abnormality detecting means for detecting an abnormality occurring in at least one of the accelerator sensor, the throttle actuator and the throttle opening controller;

fail-safe throttle opening regulating means for, at the time of abnormality detection by the abnormality detecting means, regulating the opening of the throttle valve in accordance with the position of the accelerator operating member without using a throttle control system including the accelerator sensor, the throttle actuator and the throttle opening controller; and combustion controller for, when the throttle opening regulating operation shifts to the throttle opening regulating operation performed by the fail-safe throttle opening regulating means at the time of abnormality detection, controlling combustion in the engine so as to curb fluctuation of the output torque of the engine, wherein the combustion controller curbs fluctuation of the output torque during a predetermined length of time following the abnormality detection.

20. An engine control apparatus according to claim 19, wherein said predetermined length of time is greater than the length of time required for shift to the throttle regulating operation performed by the fail-safe throttle opening regulating means.

21. An engine control apparatus according to claim 19, wherein the combustion controller controls the combustion in the engine by controlling the amount of fuel to be injected.

22. An engine control apparatus according to claim 21, wherein the combustion controller performs at least one of reduction of the amount of fuel to be injected and stopping of fuel injection.

23. An engine control apparatus according to claim 19, wherein the fail-safe throttle opening regulating means comprises:

actuator stopping means for stopping the driving of the throttle actuator if the abnormality detecting means detects an abnormality;

a cooperative member movable with the throttle valve; and a restricting member mechanically connected to the accelerator operating member and movable to a position corresponding to the accelerator operating member position so that when the driving of the throttle actuator is stopped at the time of abnormality detection by the abnormality detecting means, the restricting member contacts the cooperative member to restrict the throttle valve from further moving toward a valve opening direction, and regulates the opening of the throttle valve in accordance with the accelerator operating member position while remaining in contact with the cooperative member.

24. An engine control method comprising:

detecting the position of an accelerator operating member;

electrically regulating, in normal conditions, the opening of a throttle valve in accordance with the position of an accelerator operating member, said throttle valve being mechanically biased toward the valve opening direction, detecting an abnormality occurring in at least one of the detection of accelerator position, a throttle actuator and a throttle opening control;

stopping electrical regulation of the throttle valve if an abnormality is detected and thereafter mechanically regulating the throttle valve with a restricting member mechanically connected to move with the accelerator operating member so that when the electrical regulation of the throttle is stopped, the restricting member contacts a cooperative member mechanically linked to move with the throttle valve thus restricting the throttle valve from further moving towards a valve opening direction and thus mechanically regulating opening of the throttle valve in accordance with accelerator operating member position; and at the time of abnormality detection, controlling at least one of an amount of fuel to be injected into the engine and ignition timing so as to curb an engine output torque increase otherwise caused by a throttle valve opening movement performed after electrical regulation of the throttle valve is stopped and until the restricting member contacts the cooperative member.

25. An engine control method according to claim 24, wherein said torque increase is curbed in accordance with running conditions of a vehicle in which the engine is installed.

26. An engine control method according to claim 24, wherein the restricting member is disposed a predetermined distance apart from the cooperative member at predetermined conditions, and wherein the restricting member contacts the cooperative member when electrical regulation of the throttle is stopped at the time of abnormality detection.

27. An engine control method according to claim 24, wherein an output torque increase is curbed during a predetermined length of time following abnormality detection.

28. An engine control method according to claim 24, wherein an abnormality is detected by determining a desired opening of the throttle valve in accordance with the accelerator operating member position and comparing the desired opening of the throttle valve with an actual opening of the throttle valve.

29. An engine control method according to claim 24, further comprising:

detecting the actual opening of the throttle valve, said detecting an abnormality step including determining a desired opening of the throttle valve in accordance with the accelerator operating member position and comparing the desired opening of the throttle valve with an actual opening of the throttle valve.

30. An engine control method according to claim 27, wherein said predetermined length of time is greater than the length of time between the abnormality detection and the contacting of the restricting member and the cooperative member.

31. An engine control method according to claim 24, further comprising:

detecting the contacting of the restricting member and the cooperative member, and starting to curb an engine torque increase when the contacting of the restricting member and the cooperative member is detected.

32. An engine control method according to claim 31, wherein said contacting is detected by detecting an electric current flowing between the restricting member made of an electrically conductive material and the cooperative member made of an electrically conductive material when the restricting member and the cooperative member contact.

33. An engine control method according to claim 24, further comprising:

backup detection of an abnormality in at least one of: (a) the first-recited abnormality detection and the output torque control, (b) stopping of electrical regulation of the throttle valve and (c) controlling at least one of an amount of fuel to be injected into the engine and ignition timing so as to curb an engine output torque increase otherwise caused by a valve opening movement performed after electrical regulation of the throttle valve is stopped and until the restricting member contacts the cooperative member.

34. An engine control method according to claim 33, wherein the backup abnormality detection in at least one of the first-recited abnormality detection and the output torque control is detected on the basis of a pulse signal outputted at a predetermined time interval by at least one of the first-recited abnormality detection and the output torque control steps.

35. An engine control method according to claim 24, wherein the output torque control performs fuel injection skip control for stopping fuel injection for predetermined cylinders of a multi-cylinder engine so as to curb an engine output torque increase.

36. An engine control method according to claim 35, wherein the output torque control includes determining the number of cylinders in which to omit fuel injection in the fuel injection skip control, in accordance with running conditions of a vehicle in which the engine is installed.

37. An engine control method according to claim 36, wherein at least one of (a) gear position in a transmission disposed in an engine power transmitting system, (b) vehicle speed, and (c) accelerator operation amount is used as a detection factor corresponding to said running conditions.

38. An engine control method according to claim 37, wherein the output torque control step includes increasing the number of cylinders to omit for a lower speed gear position selected.

39. An engine control method according to claim 35, wherein the output torque control step gradually reduces the number of cylinders to omit when the torque control shifts from the fuel injection skip control to normal fuel injection control.

40. An engine control method according to claim 35, wherein the output torque control step selects cylinders to omit from fuel injection so that the omitted cylinders are substantially evenly distributed with respect to a combustion sequence of all the cylinders.

41. An engine control method according to claim 39, wherein the output torque control step gradually reduces the number of omitted cylinders at a regular cycle of elapsed times.

42. An engine control method comprising:

detecting the position of an accelerator operating member and electrically regulating, in normal conditions, the opening of a throttle valve that is mechanically biased toward the valve opening direction to control the opening of the throttle valve in accordance with the detected position of the accelerator operating member;

detecting an abnormality occurring in at least one of the accelerator position detection and the throttle opening regulation steps;

fail-safe regulating the throttle opening, at and after the time of abnormality detection, by mechanically regulating the opening of the throttle valve in accordance with the position of the accelerator operating member without using an electrical throttle control system; and when the throttle opening regulation shifts to the mechanical throttle regulating operation at the time of abnormality detection, controlling combustion in the engine so as to curb fluctuation of the output torque of the engine.

43. An engine control method according to claim 42, wherein the combustion control curbs fluctuation of the engine output torque during a predetermined length of time following abnormality detection.

44. An engine control method according to claim 43, wherein said predetermined length of time is greater than the length of time required for shift to mechanical throttle regulating operation.

45. An engine control method according to claim 42, wherein the combustion control controls combustion in the engine by controlling the amount of fuel to be injected.

46. An engine control method according to claim 45, wherein the combustion control performs at least one of reduction of the amount of fuel to be injected and stopping of the fuel injection to selected cylinders.

47. An engine control method according to claim 42, wherein the fail-safe throttle opening regulation comprises:

stopping an electrical driving of the throttle valve if an abnormality is detected and thereafter mechanically regulating throttle valve position via a restricting member mechanically connected to move with the accelerator operating member position so that when electrical driving of the throttle valve is stopped by abnormality detection, the restricting member contacts a cooperative member mechanically linked to move with the throttle valve and thereby to restrict the throttle valve from further moving towards a valve opening direction, while regulating the opening of the throttle valve in accordance with accelerator operating member position by virtue of the restricting member remaining in contact with the cooperative member.

48. A fail-safe engine accelerator-throttle control method comprising:

electrically moving a throttle;

disabling said electrically moving operation;

mechanically moving, upon said disabling operation, a first member along a predetermined path in accordance with throttle movements while also mechanically biasing it to move therealong towards a throttle opening direction; and mechanically moving a second member along said predetermined path in accordance with accelerator movements to stop said first member from further movement towards the throttle opening direction upon contact therebetween.

49. A fail-safe engine accelerator-throttle control method as in claim 48 further comprising:

mechanically linking said first member to move back and forth in response to rotary throttle movements and is spring-biased by a first force toward the throttle-open direction of movement; and mechanically linking said second member to move back and forth in response to changes in accelerator position and spring-biasing it by a second force toward the throttle-closed direction of movement against a predetermined stop in the accelerator idle position, said second force being greater than said first force.

50. A fail-safe engine accelerator-throttle control method as in claim 48 further comprising:

generating a back-up reduced fuel-injection signal;

generating a back-up traveling fuel-injection signal; and passing said reduced fuel-injection signal to control the engine for a first time interval after said disabling operation due to an abnormality in said electrically moving operation occurs and thereafter passing said traveling fuel-injection signal to control the engine.

51. A fail-safe engine accelerator-throttle control method as in claim 48 further comprising:

generating a cylinder-skipping fuel injection signal;

generating a non-cylinder-skipping fuel injection signal; and passing said cylinder-skipping fuel injection signal to control the engine for a first time interval after said disabling operation due to an abnormality in said electrically moving operation occurs and thereafter passing said non-cylinder-skipping fuel injection signal to control said engine.

52. A fail-safe engine accelerator-throttle control method as in claim 51 further comprising:

monitoring an engine running condition;

using said monitored engine running condition to change the number of cylinders for which fuel injection is skipped.

53. A fail-safe engine accelerator-throttle control method as in claim 52, wherein said cylinder-skipping fuel injection signal is used to selectively distribute the skipped cylinders over an entire multi-cylinder engine cycle.

54. A fail-safe engine accelerator-throttle control method as in claim 48, further comprising:

changing, upon said disabling operation, engine control mode to reduce engine output torque relative to movement of said throttle in said opening direction by said first member.

55. A fail-safe engine accelerator-throttle control method as in claim 54, wherein said changing engine control mode includes at least one of reducing fuel amount to said engine and retarding ignition timing relative to said movement of said throttle in said opening direction.

* * * * *